US009751124B2

(12) United States Patent
Leicht et al.

(10) Patent No.: US 9,751,124 B2
(45) Date of Patent: Sep. 5, 2017

(54) SYSTEM AND METHOD OF MAKING A FORGED PART

(71) Applicant: ArvinMeritor Technology, LLC, Troy, MI (US)

(72) Inventors: Phillip Leicht, South Lyon, MI (US); Paul Bore, Clarkston, MI (US)

(73) Assignee: ArvinMeritor Technology, LLC, Troy, MI (US)

( * ) Notice: Subject to any disclaimer, the term of this patent is extended or adjusted under 35 U.S.C. 154(b) by 970 days.

(21) Appl. No.: 13/752,844

(22) Filed: Jan. 29, 2013

(65) Prior Publication Data

US 2014/0208818 A1 Jul. 31, 2014

(51) Int. Cl.

| | |
|---|---|
| ***B21J 5/08*** | (2006.01) |
| ***B21D 22/20*** | (2006.01) |
| ***B21K 21/08*** | (2006.01) |
| ***B21K 23/04*** | (2006.01) |
| ***B21J 5/10*** | (2006.01) |

(52) U.S. Cl.
CPC ..... *B21D 22/20* (2013.01); *B21J 5/08* (2013.01); *B21J 5/10* (2013.01); *B21K 21/08* (2013.01); *B21K 23/04* (2013.01)

(58) Field of Classification Search
CPC ..... B21J 5/02; B21J 5/025; B21J 5/06; B21J 9/02; B21J 9/022; B21J 13/00; B21J 5/08; B21J 5/10; B21K 21/08; B21K 23/04; B21D 22/20
See application file for complete search history.

(56) References Cited

U.S. PATENT DOCUMENTS

| | | | | |
|---|---|---|---|---|
| 537,577 | A | 4/1895 | Mason | |
| 2,089,784 | A * | 8/1937 | Cornell, Jr. | B21J 5/08 285/148.9 |
| 4,362,043 | A | 12/1982 | Hanson | |
| 4,382,324 | A * | 5/1983 | Halene | B26D 7/086 72/356 |
| 4,470,282 | A * | 9/1984 | Hayashi | B21B 19/04 72/97 |
| 4,571,977 | A | 2/1986 | Ueno et al. | |
| 4,939,829 | A * | 7/1990 | Maki | B21K 1/30 72/356 |
| 5,689,882 | A | 11/1997 | Adachi et al. | |

(Continued)

FOREIGN PATENT DOCUMENTS

| | | |
|---|---|---|
| CN | 201020508 Y | 2/2008 |
| EP | 1611973 A1 | 1/2006 |

(Continued)

OTHER PUBLICATIONS

European Patent Office, Extended European Search Report for the corresponding European Patent Application No. 14150033.0 mailed May 22, 2014.

(Continued)

*Primary Examiner* — David Bryant
*Assistant Examiner* — Pradeep C Battula
(74) *Attorney, Agent, or Firm* — Brooks Kushman P.C.

(57) ABSTRACT

A system and method of making a forged part. A flange may be forged between first and second ends of the part by actuating an upset punch against a second end of the tube that is disposed opposite the first end. The flange may extend away from an axis along which an upset punch is actuated.

19 Claims, 8 Drawing Sheets

(56) References Cited

U.S. PATENT DOCUMENTS

| | | | | |
|---|---|---|---|---|
| 5,898,997 | A | 5/1999 | Meeker et al. | |
| 8,402,661 | B2 * | 3/2013 | Kobayashi | B21J 5/02 29/894.36 |
| 8,770,005 | B2 * | 7/2014 | Kobayashi | B21J 5/06 72/352 |

FOREIGN PATENT DOCUMENTS

| | | | |
|---|---|---|---|
| JP | S5850146 | A | 3/1983 |
| JP | H05123816 | A | 5/1993 |
| JP | H0698443 | B2 | 12/1994 |
| JP | 2001038444 | A | 2/2001 |

OTHER PUBLICATIONS

Chinese Search Report for CN Application No. 201410037495.5, dated May 29, 2015, 8 pages.

* cited by examiner

SYSTEM AND METHOD OF MAKING A FORGED PART

TECHNICAL FIELD

This application relates to a system and method of making a forged part, such as a spindle for supporting a vehicle wheel assembly.

BACKGROUND

A method of producing a spindle is disclosed in U.S. Pat. No. 5,689,882.

SUMMARY

In at least one embodiment, a method of making a forged part is provided. A workpiece may be positioned in a cavity of an upset die such that a first end of the workpiece engages an end surface of the upset die. An upset punch may be actuated along an axis to engage a second end of the workpiece to forge a flange. The flange may extend radially away from the axis and may be disposed between and may be spaced apart from the first and second ends.

In at least one embodiment, a method of making a forged part is provided. A workpiece configured as a non-tubular billet may be forged into a tube that may extend along an axis and may have a through hole. The tube may be positioned in a cavity of an upset die such that a first end of the tube engages an end surface of the upset die. An upset punch may be actuated against a second end of the tube that is disposed opposite the first end to forge a flange between the first and second ends. The flange may be disposed opposite the through hole and may extend away from the axis.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
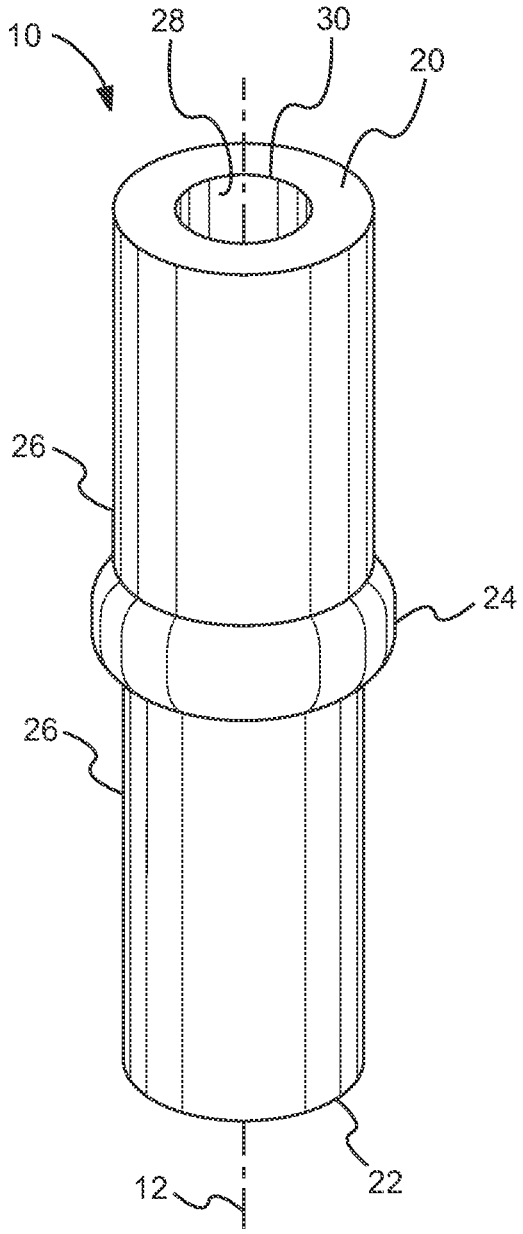
FIG. 1 is an illustration of an exemplary forged part.

Referring to FIG. 1, an example of a forged part 10 is shown. The forged part 10 may extend along an axis 12 and may be made of any suitable metal material, such as a metal alloy like steel. In FIG. 1, the part 10 is configured as a spindle that may support a wheel hub assembly that may facilitate mounting and rotation of a vehicle wheel. Such a spindle may be press fit into a hole in a steering knuckle, which may be part of a steering system that may be used to steer or change the direction of a motor vehicle like a truck, bus, farm equipment, military transport or weaponry vehicle, or cargo loading equipment for land, air, or marine vessels. Alternatively, the part 10 may be another motor vehicle component, such as an input shaft or drive pinion that may be provided with a vehicle axle assembly.

The part 10 may have a tubular or non-tubular configuration. In a tubular configuration, the part 10 may have a first end 20, a second end 22, a flange 24, an outer surface 26, and an inner surface 28 that may define a through hole 30. The first end 20 may be disposed opposite the second end 22. In addition, the first and second ends 20, 22 may be substantially parallel in one or more embodiments. The flange 24 may be disposed between and may be spaced apart from the first and second ends 20, 22. The flange 24 may extend outwardly from the outer surface 26 or away from the axis 12 and may have a curved or arcuate configuration in one or more embodiments. The outer surface 26 may be spaced apart from the axis 12 and may define an outside circumference or outside diameter of at least a portion of the part 10 in one or more embodiments. The inner surface 28 may be disposed opposite the outer surface 26. The inner surface 28 may be spaced part from the axis 12 and may define an inside circumference or inside diameter of the part 10 in one or more embodiments. In a non-tubular configuration, the inner surface 28 and through hole 30 and may be omitted. As such, a part 10 having a non-tubular configuration may be solid rather than hollow or tubular and the axis 12 may intersect the first and second ends 20, 22.

One or more forging die sets may be used to forge the part 10. Forging utilizes compressive force to shape a metal or metal alloy by plastic deformation in a die. Plastic deformation may be facilitated by heating the metal or metal alloy prior to the application of compressive force.

Figure 2:
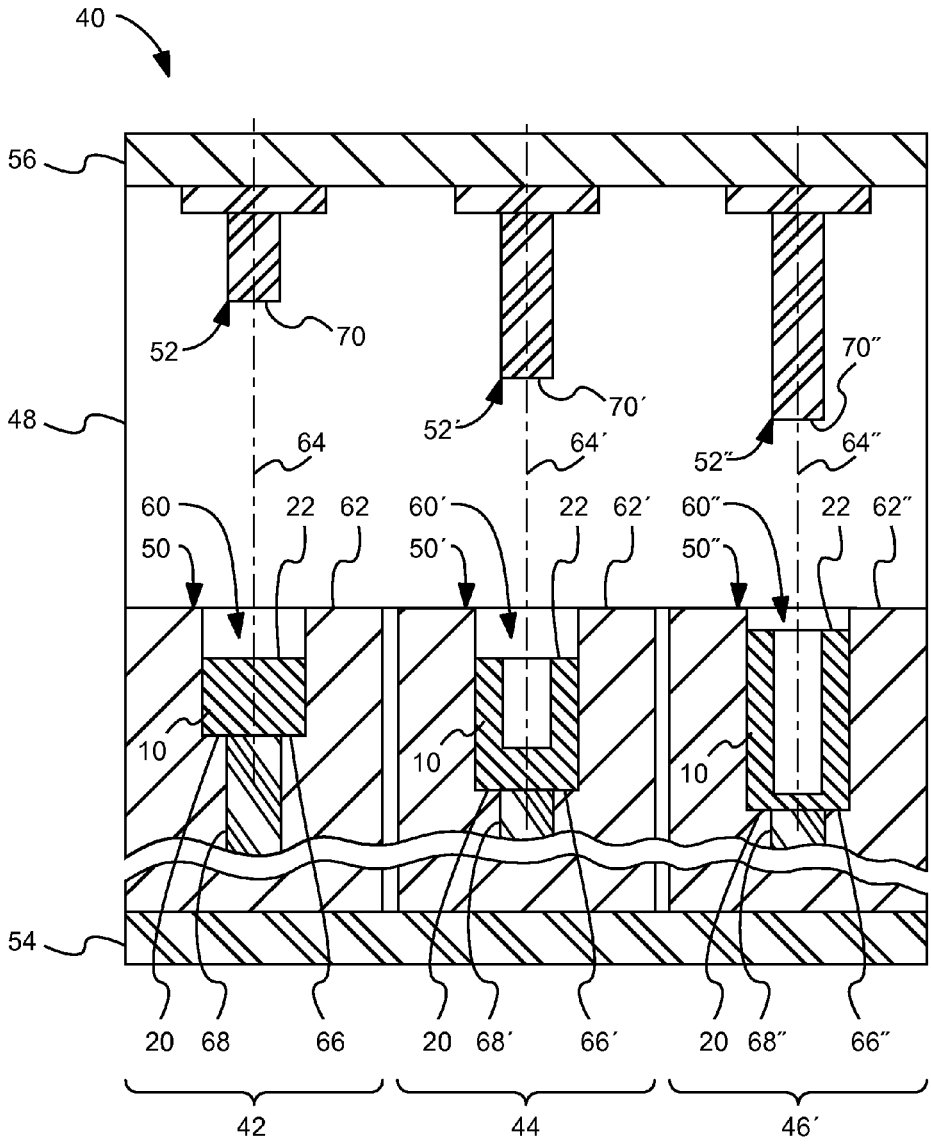
FIGS. 2 and 3 are cross-sectional views of an exemplary tube forging die set illustrating forging of a tube.
Figure 3:
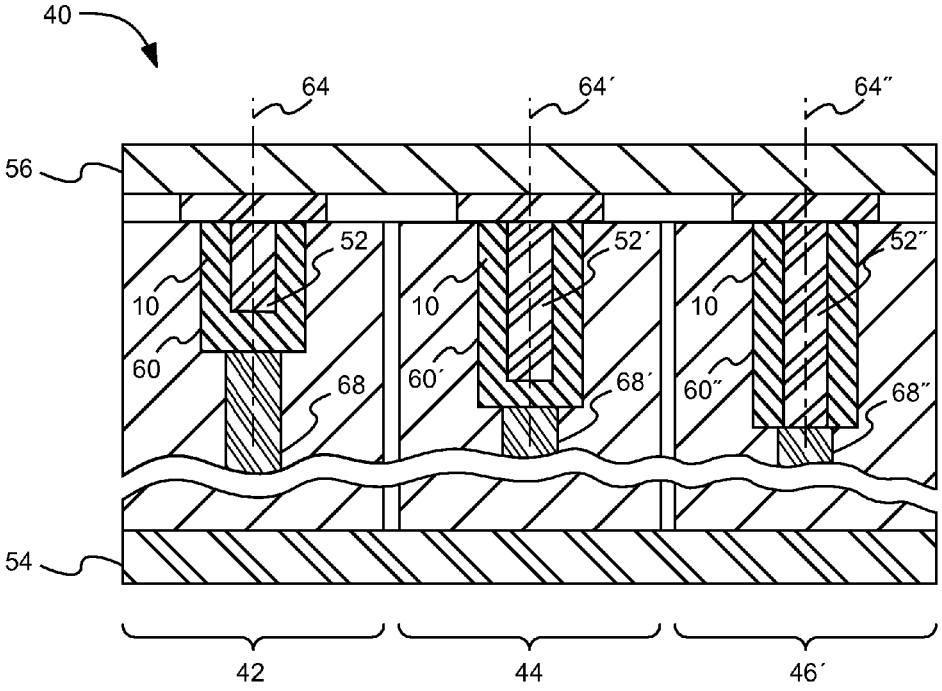

Referring to FIGS. 2 and 3, an exemplary tube forging die set 40 is shown. The tube forging die set 40 may receive and forge a workpiece, such a billet, into a hollow tube. A billet may be a semi-finished bar of a metallic material that may be provided in the form of the cylinder or rectangular prism. In this application, the terms workpiece and billet may be used to refer to material that is in the process of being manufactured into a forged part 10. For clarity in the Figures, reference number 10 may be used interchangeably to refer to the part in any stage of manufacture (i.e., reference number 10 may be used to reference a workpiece, billet, or forged part).

The tube forging die set 40 may include one or more die assemblies that may have a die and a punch. In FIGS. 2 and 3, a first die assembly 42, a second die assembly 44, and a third die assembly 46 are shown, although it is contemplated that a greater or lesser number of die assemblies may be provided. Multiple die assemblies may be disposed in a common press or in different presses that may be used to actuate a die and/or a punch to forge the workpiece. In FIGS. 2 and 3, each die is illustrated as being fixedly positioned and the press 48 moves each corresponding punch with respect to the die. Alternatively, the press may move a die with respect to a stationary punch or the press may actuate both the die and the punch in one or more embodiments. Moreover, the press may actuate the die and/or punch linearly or along a linear axis that may coincide with or extend parallel to the axis 12 of the part 10. Each die assembly 42, 44, 46 may also be provided with heating and/or cooling elements that may help control the die temperature, such as a water jacket.

The first die assembly 42 may include a first die 50 and a first punch 52. The first die 50 may be disposed on a die mounting plate 54. The first punch 52 may be disposed on a punch mounting plate 56.

The first die 50 may have a first die cavity 60 that may be configured to receive the workpiece. The first die cavity 60 may extend from an upper surface 62 of the first die 50. In at least one embodiment, the first die cavity 60 may be substantially cylindrical and may extend along a first die assembly axis 64. The first die cavity 60 may have a bottom surface 66. The bottom surface 66 may be disposed proximate or may be at least partially defined by one or more ejector pins 68 that may facilitate ejection or removal of the workpiece from the first die cavity 60. As is best shown in FIG. 2, the depth of the first die cavity 60 or axial distance from the upper surface 62 to the bottom surface 66 may be greater than the height of the workpiece to provide space to facilitate forging of the workpiece within the first die 50.

The first punch 52 may be configured to engage and exert force on a workpiece disposed in the first die cavity 60. For example, the first punch 52 may engage a portion of the second end 22. In at least one embodiment, the first punch 52 may be substantially cylindrical and may extend along the first die assembly axis 64 to a distal end or first punch end surface 70. The first punch 52 may have a smaller diameter than the first die cavity 60 to facilitate insertion into the first die cavity 60.

The second die assembly 44 may include a second die 50' and a second punch 52'. The second die 50' may be disposed on the die mounting plate 54 and the second punch 52' may be disposed on the punch mounting plate 56 in one or more embodiments.

The second die 50' may have a second die cavity 60' that may be configured to receive the workpiece after forging in the first die assembly 42. The second die cavity 60' may extend from an upper surface 62' of the second die 50' along a second die assembly axis 64'. The second die cavity 60' may be substantially cylindrical and may have a diameter that is substantially the same as that of the first die cavity 60. The second die cavity 60' may have a bottom surface 66' that may be disposed proximate or may be at least partially defined by one or more ejector pins 68' that may facilitate ejection or removal of the workpiece from the second die cavity 60'. As is best shown in FIG. 2, the depth of the second die cavity 60' or axial distance from the upper surface 62' to the bottom surface 66' may be greater than the height of the workpiece to provide space to facilitate forging. Moreover, the depth of the second die cavity 60' may be greater than the depth of the first die cavity 60. As such, the second die cavity 60' may have a greater volume than the first die cavity 60.

The second punch 52' may be configured to engage and exert force on a workpiece disposed in the second die cavity 60'. In at least one embodiment, the second punch 52' may be substantially cylindrical and may extend along the second die assembly axis 64' to a distal end or second punch end surface 70'. The second punch 52' may have a smaller diameter than the second die cavity 60' to facilitate insertion into the second die cavity 60'. Moreover, the second punch 52' may have a greater length (e.g., axial distance from the punch mounting plate 56 to the second punch end surface 70') than the first punch 52.

The third die assembly 46 may include a third die 50" and a third punch 52". The third die 50" may be disposed on the die mounting plate 54 and the third punch 52" may be disposed on the punch mounting plate 56 in one or more embodiments.

The third die 50" may have a third die cavity 60" that may be configured to receive the workpiece after forging in the second die assembly 44. The third die cavity 60" may extend from an upper surface 62" of the third die 50" along a third die assembly axis 64". The third die cavity 60" may be substantially cylindrical and may have a diameter that is substantially the same as that of the first die cavity 60 and/or the second die cavity 60'. The third die cavity 60" may have a bottom surface 66" that may be disposed proximate or may be at least partially defined by one or more ejector pins 68" that may facilitate ejection or removal of the workpiece from the third die cavity 60". As is best shown in FIG. 2, the depth of the third die cavity 60" or axial distance from the upper surface 62" to the bottom surface 66" may be greater than the height of the workpiece to provide space to facilitate forging. Moreover, the depth of the third die cavity 60" may be greater than the depth of the second die cavity 60'. As such, the third die cavity 60" may have a greater volume than the second die cavity 60'.

The third punch 52" may be configured to engage and exert force on a workpiece disposed in the third die cavity 60". In at least one embodiment, the third punch 52" may be substantially cylindrical and may extend along the third die assembly axis 64" to a distal end or third punch end surface 70". The third punch 52" may have a smaller diameter than the third die cavity 60" to facilitate insertion into the third die cavity 60". Moreover, the third punch 52" may have a greater length (e.g., axial distance from the punch mounting plate 56 to the third punch end surface 70") than the second punch 52'. As such, the third punch 52" may be configured to pierce through the workpiece or engage the bottom surface 66" of the third die cavity 60" during forging to form the workpiece into a hollow tube having a through hole.

Figure 4:
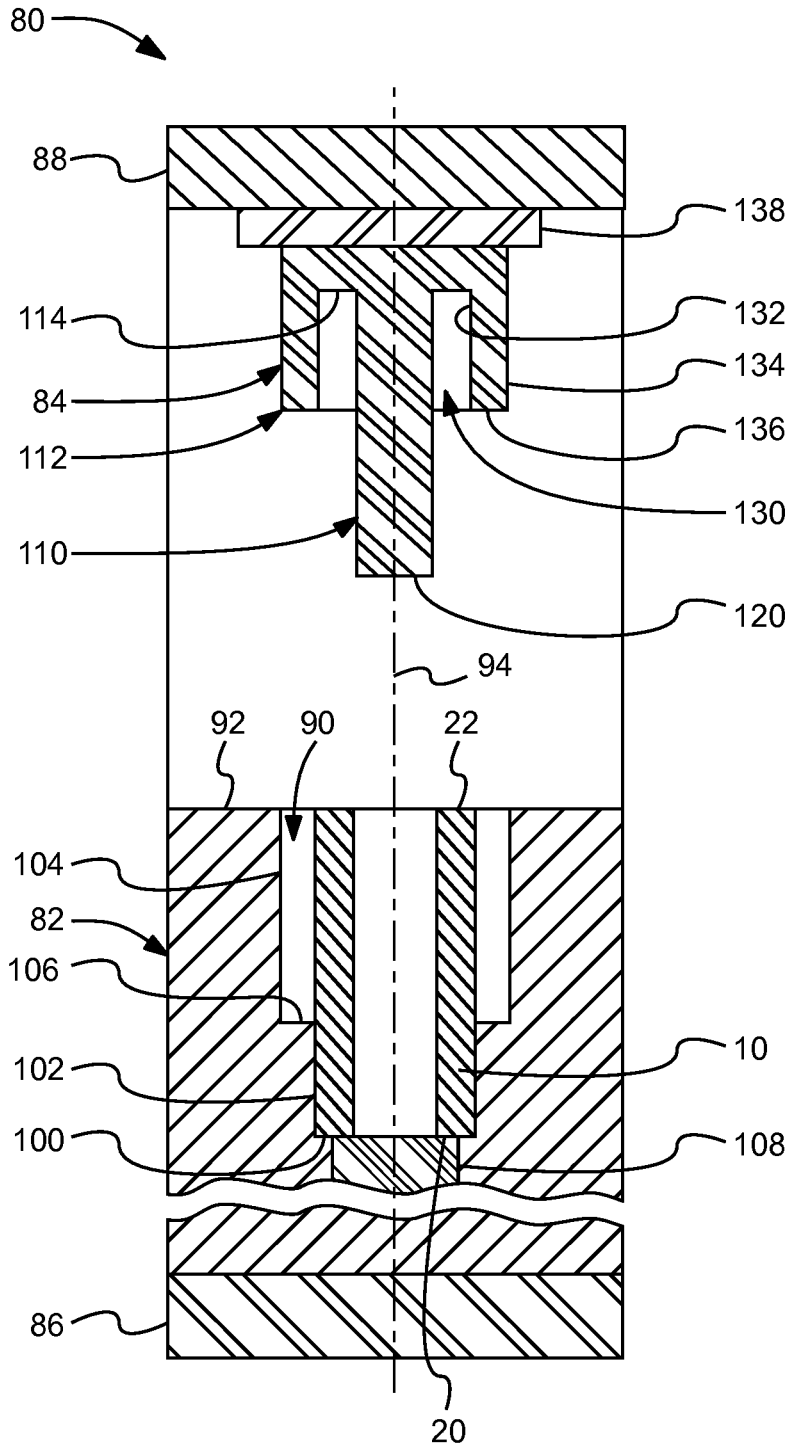
FIGS. 4 and 5 are cross-sectional views of an exemplary upset forging die set illustrating forging of a flange.
Figure 5:
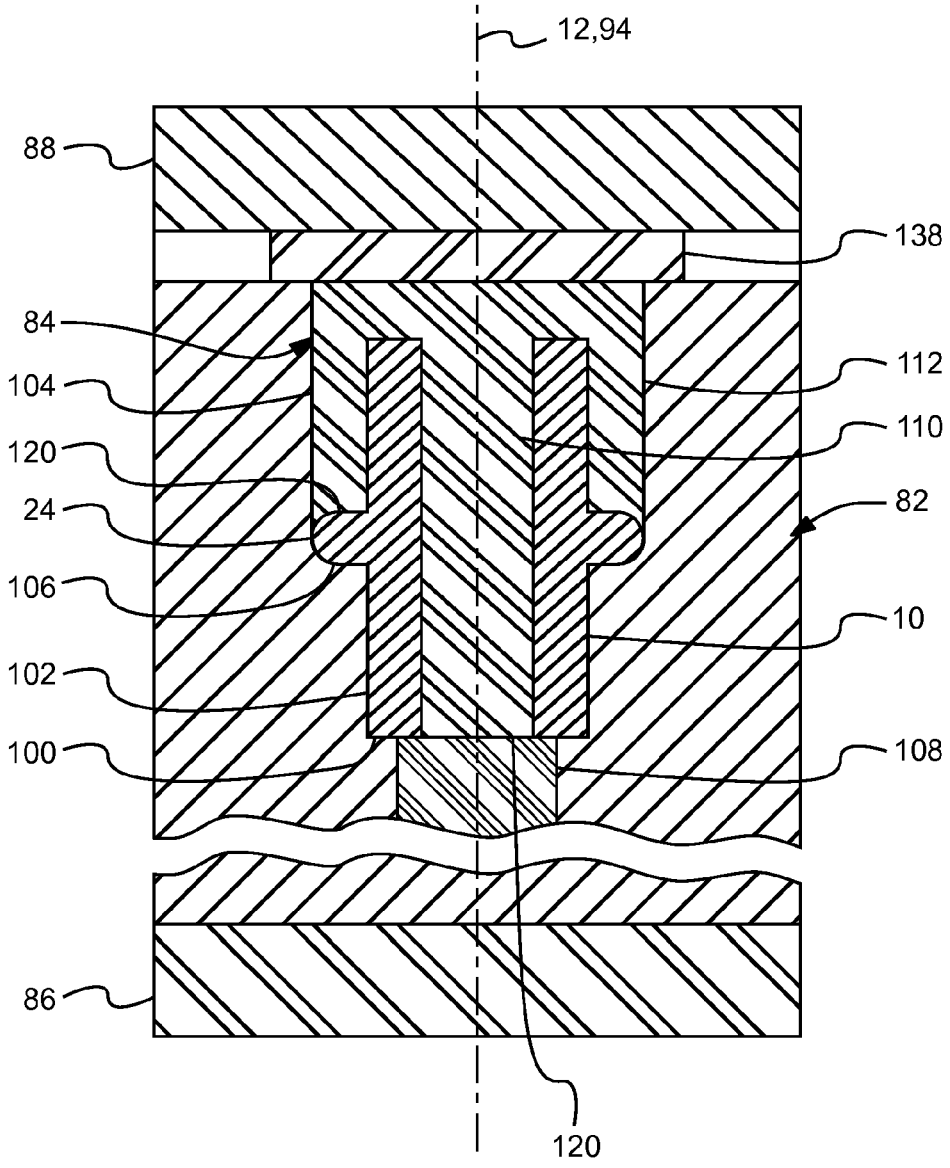

Referring to FIGS. 4 and 5, an exemplary upset forging die set 80 is shown. In the embodiment shown, the upset forging die set 80 may receive and forge a workpiece configured as a hollow tube into a forged part 10. More specifically, the upset forging die set 80 may be used to forge the flange 24. The upset forging die set 80 may include an upset forging die assembly that may include an upset die 82 and an upset punch 84. The upset die 82 may be disposed on an upset die mounting plate 86. The upset punch 84 may be disposed on an upset punch mounting plate 88.

The upset forging die assembly may be disposed in a press that may be used to actuate the upset die 82 and/or the upset punch 84. In FIGS. 4 and 5, the upset die 82 is fixedly positioned and the press moves the upset punch 84 with respect to the upset die 82. Alternatively, the press may move upset die 82 with respect to a stationary upset punch 84 or the press may actuate both the upset die 82 and the upset punch 84 in one or more embodiments. The press employed with the upset forging die assembly may be different than the press that is utilized with the tube forging die set 40. Moreover, the press may actuate the upset die 82 and/or upset punch 84 linearly or along a linear axis that may coincide with or extend parallel to the axis 12 of the part 10.

The upset die 82 may have an upset die cavity 90 that may be configured to receive the workpiece. The upset die cavity 90 may extend from an upper surface 92 of the upset die 82. In at least one embodiment, the upset die cavity 90 may extend along an upset die assembly axis 94 and may be at least partially defined by an end surface 100, a first surface 102, a second surface 104, and a step surface 106.

The end surface 100 may be disposed at an end of the upset die cavity 90. The end surface 100 may be disposed proximate or may be at least partially defined by one or more ejector pins 108 that may facilitate ejection or removal of the workpiece from the upset die cavity 90. As is best shown in FIG. 4, the depth of the upset die cavity 90 or axial distance from the upper surface 92 to the end surface 100 may be similar to the height of the workpiece prior to forging the flange 24. Moreover, the depth of the upset die cavity 90 or axial distance from the upper surface 92 to the end surface 100 may be greater than the height or axial length of the forged part 10 or workpiece after forging as is best shown in FIG. 5.

The first surface 102 may extend from the end surface 100 to the step surface 106 and may be substantially cylindrical or radially disposed with respect to the upset die assembly axis 94 in one or more embodiments.

The second surface 104 may extend from the step surface 106 to the upper surface 92 and may also be substantially cylindrical or radially disposed with respect to the upset die assembly axis 94 in one or more embodiments. The second surface 104 may have a larger diameter than the first surface 102. As such, the first and second surfaces 102, 104 may be coaxially or concentrically disposed.

The step surface 106 may extend from the first surface 102 to the second surface 104. In at least one embodiment, the step surface 106 may be disposed substantially perpendicular to the upset die assembly axis 94.

The upset punch 84 may be configured to engage and exert force on a workpiece disposed in the upset die cavity 90 during forging. The upset punch 84 may have a smaller diameter than the first upset die cavity 90 to facilitate insertion into the upset die cavity 90. In at least one embodiment, the upset punch 84 may include a punch shaft portion 110, a flange forming portion 112 and a bottom punch surface 114.

The punch shaft portion 110 may maintain the tubular shape of the workpiece during forging of the flange 24. More specifically, the punch shaft portion 110 may be received in the through hole 30 and may engage the inner surface 28 when the upset punch 84 is actuated into the upset die 82 to forge the flange 24. The punch shaft portion 110 may extend along the upset die assembly axis 94 and may be substantially cylindrical. The punch shaft portion 110 may have a punch end surface 120 disposed at a distal end. As is best shown in FIG. 5, the punch end surface 120 may be disposed proximate to or may engage the end surface 100 of the upset die 82 when the upset punch 84 is actuated into the upset die 82 to forge the flange 24.

The flange forming portion 112 may be spaced apart from the punch shaft portion 110. As such, a gap 130 may be provided between the flange forming portion 112 and the punch shaft portion 110 that may receive the tubular workpiece. The flange forming portion 112 may have an interior surface 132, an exterior surface 134, and a flange forming end surface 136. The interior surface 132 may extend from the bottom punch surface 114 to the flange forming end surface 136. The exterior surface 134 may be spaced apart from the interior surface 132 may extend from a punch plate 138 to the flange forming end surface 136. The flange forming end surface 136 may extend from the interior surface 132 to the exterior surface 134. The interior and exterior surfaces 132 134 may be radially disposed with respect to the upset die assembly axis 94. As such, the flange forming portion 112 may be configured as a substantially cylindrical ring that may extend continuously around the punch shaft portion 110. Moreover, the flange forming portion 112 and punch shaft portion 110 may be concentrically disposed about the upset die assembly axis 94.

The flange forming portion 112 may have a shorter length or axial distance than the punch shaft portion 110. More specifically, the length of the flange forming portion 112 from the bottom punch surface 114 to the flange forming end surface 136 may be less than the length of the punch shaft portion 110, or distance from the bottom punch surface 114 to the punch end surface 120.

The bottom punch surface 114 may extend from the punch shaft portion 110 to the flange forming portion 112. The bottom punch surface 114 may engage the second end 22 when the upset punch 84 is actuated to forge the flange 24.

Figure 6:
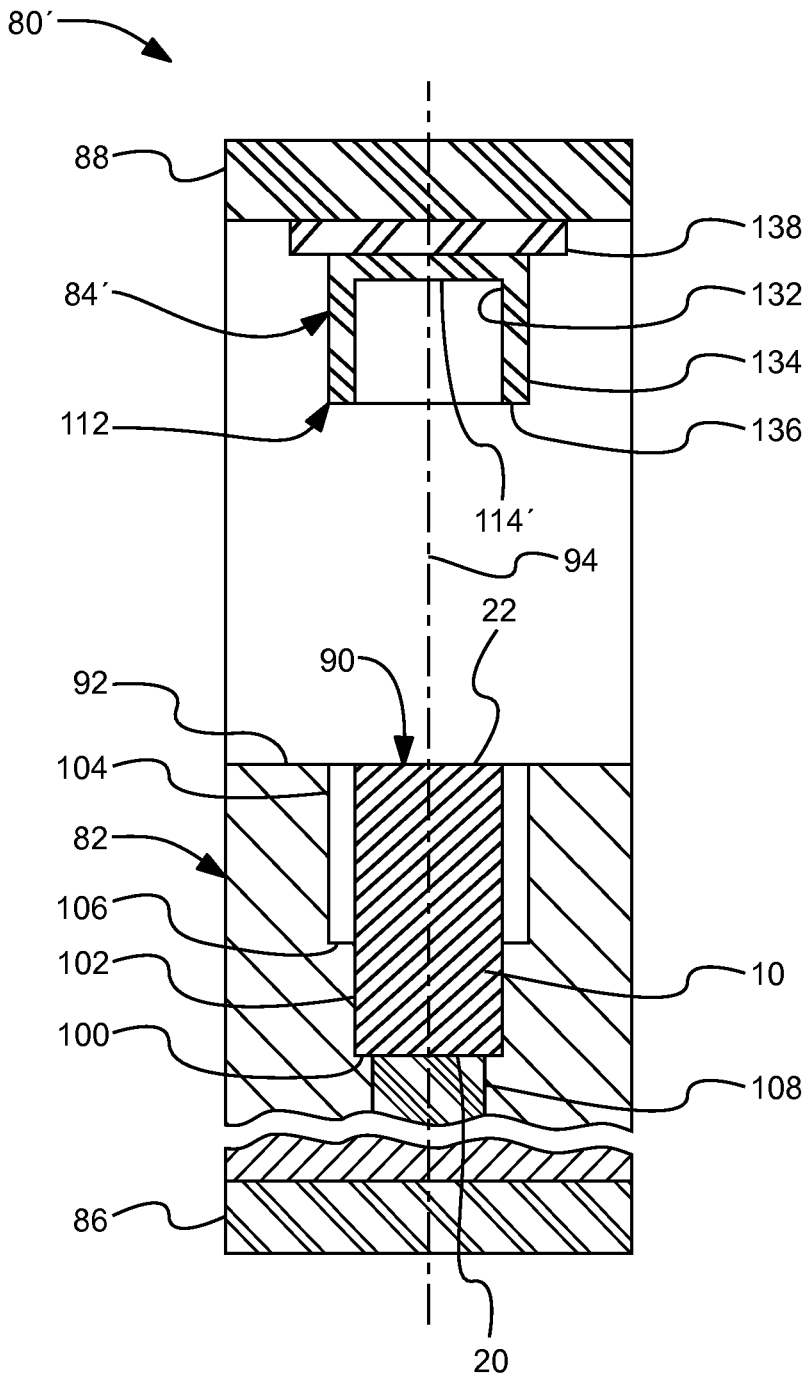
FIGS. 6 and 7 are cross-sectional views of another upset forging die set illustrating forging of a flange on a non-tubular workpiece.
Figure 7:
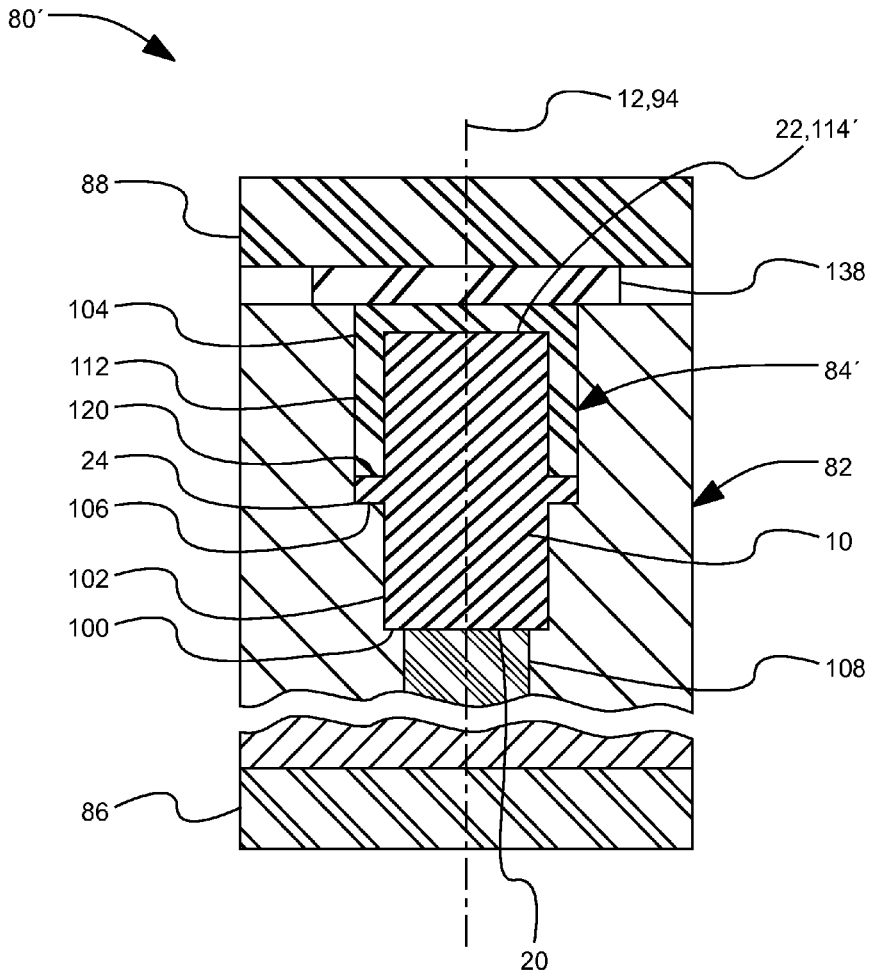

Referring to FIGS. 6 and 7, another embodiment of an upset forging die set 80' is shown. In this embodiment, the upset forging die set 80 may receive and forge a flange 24 onto a workpiece that is not configured as a hollow tube. The upset forging die set 80' may include an upset forging die assembly that may include the upset die 82 and an upset punch 84'.

The upset punch 84' may omit the punch shaft portion 110 that is provided with the upset punch 84 previously described. As such, the flange forming portion 112 may contain a bottom punch surface 114' that may extend from continuously from the upset die assembly axis 94 to the interior surface 132 of the flange forming portion 112.

Figure 8:
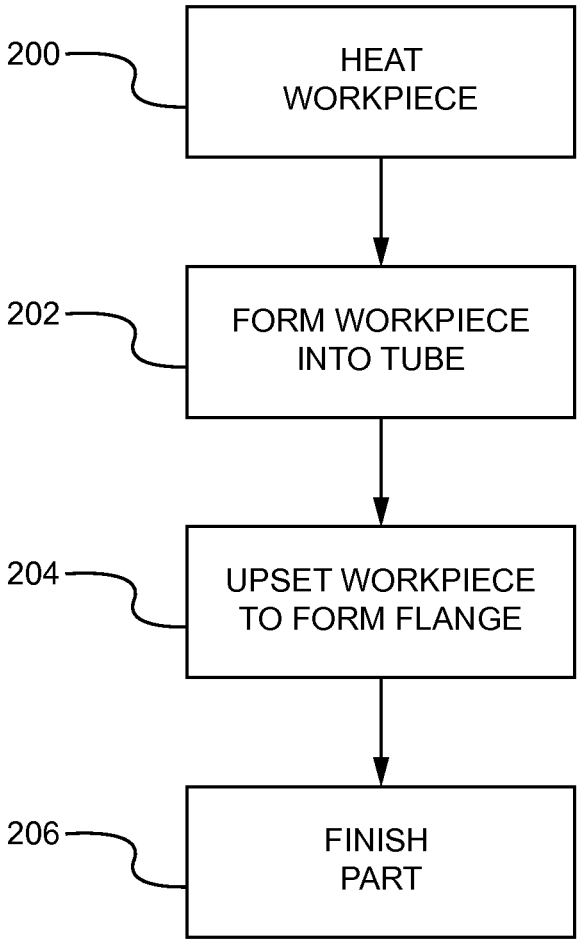
FIG. 8 is a flowchart of a method of making a forged part.

Referring to FIG. 8, an exemplary method of making a forged part is shown. Various method steps may be omitted when the part has a non-tubular configuration as will be discussed in more detail below.

At block 200, the method may begin by heating the workpiece that may forged into the part 10. The workpiece may be provided in the form of a billet as previously discussed. The workpiece may be heated well above ambient temperature to facilitate plastic deformation or hot forging. For example, the workpiece may be heated above a recrystallization temperature of the material from which the workpiece is made to facilitate or permit plastic deformation to occur. The recrystallization temperature may be less than the melting temperature of the material.

At block 202, the workpiece may be formed into a tube. This step may be omitted when forging a part having a non-tubular configuration such as is shown in FIGS. 6 and 7. The workpiece may be forged into a tube using a tube forging die set having one or more die assemblies as previously discussed. As an example, forging of a tube will be described with reference to a tube forging die set 40 having three die assemblies 42, 44, 46 as previously described and shown in FIGS. 2 and 3. The workpiece may be positioned in the first die cavity 60 such that a first end 20 of the workpiece engages the bottom surface 66 of the first die 50. The first die 50 and/or first punch 52 may be actuated and the first die 50 and first punch 52 may cooperate to forge the workpiece from the configuration shown in FIG. 2 to that shown in FIG. 3. As such, a blind hole may be formed in the workpiece by the first punch 52 and workpiece material may be forced into the gap between the exterior of the first die 50 and the interior of the first punch 52 and advance toward the upper surface 62. The press may then retract the first die 50 and/or first punch 52 back to the position shown in FIG. 2 to facilitate removal of the workpiece from the first die 50. For example, one or more ejector pins 68 may be actuated to push the workpiece at least partially out of the first die 50. The workpiece may then be transferred to the second die 50' in any suitable manner, such as with a manipulator like a robot that may have an end effector configured as a gripper for grasping the workpiece. The workpiece may then be forged in a similar manner and further elongated by the second die assembly 44, then ejected and transferred to the third die assembly 46, and forged into a tube in the third die assembly 46 as is best shown by comparing FIG. 2 to FIG. 3.

At block 204, the workpiece may be upset to form the flange 24. The upset forging die set 80 shown in FIGS. 4 and 5 may be used to forge the flange on a tubular workpiece while the forging die set 80' shown in FIGS. 6 and 7 may be used to forge the flange on a non-tubular workpiece. In either case, the upset punch 84, 84' may exert force on the second end 22 to force the workpiece material into a flange forming gap 130 that may be bounded by the flange forming portion 112 of the upset punch 84, 84', the second surface 104 of the upset die 82 and the step surface 106 of the upset die 82. The axial length of the workpiece may be reduced when the flange 24 is forged, but the workpiece may not be buckled, folded or provided with any void as may occur using other manufacturing technniques. Moreover, a workpiece having a tubular configuration may remain in continuous engagement with the punch shaft portion 110 during forging of the flange 24. The press may then actuate the upset forging die set 80, 80' so that the part 10 may be ejected using one or more ejector pins 108.

At block 206, finishing operations may be performed on the forged part 10. For example, the part 10 may be quenched to provide a desired material characteristics, material may be removed to provide a desired final geometry or surface finish, and/or threads may be provided on a portion of the part 10. Other forging methods may include length extrusion from a larger diameter preform.

The system and method described above may allow a forged part having a flange to be made with improved throughput and material utilization and may help reduce tooling setup or press changeover between products. In addition, machining operations and material waste may be reduced as compared to a process in which a flange is made by turning or removing material from the exterior of a workpiece. For example, the system and method may allow a flange to be formed by upsetting or increasing the diameter of a workpiece at a desired flange location to form a flange rather than by reducing the diameter of a workpiece adjacent to a desired flange location, such as via material removal or extrusion. Moreover, the system and method may allow a flange to be upset on a tubular part rather than forming a hole in the part when the workpiece is extruded to reduce its diameter and form a flange.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of making a forged part comprising:

forging a workpiece configured as a non-tubular billet into a tube that extends along an axis and has a through hole;

positioning the tube in a cavity of an upset die such that a first end of the tube engages an end surface of the upset die; and actuating an upset punch against a second end of the tube that is disposed opposite the first end to forge a flange between the first and second ends, wherein the flange is disposed opposite the through hole and extends away from the axis, the upset punch is disposed on a punch plate, the upset punch has a punch shaft portion that extends along an upset die assembly axis and has a punch end surface disposed at a distal end, the punch end surface is not disposed parallel to the axis and the upset die assembly axis, and the punch plate directly engages an upper surface of the upset die and the punch end surface directly engages the end surface of the upset die when the upset punch is actuated into the upset die to forge the flange.

2. The method of claim 1 wherein the part is a spindle for rotatably supporting a vehicle wheel.

3. The method of claim 1 further comprising heating the workpiece before forging the workpiece into the tube.

4. The method of claim 1 wherein the tube is heated above a recrystallization temperature before forging the flange.

5. The method of claim 1 wherein an axial length of the tube from the first end to the second end is reduced when the flange is forged.

6. The method of claim 1 wherein the upset die further comprises a first surface that extends from the end surface, a second surface that is spaced apart from the first surface, and a step surface that extends from the first surface to the second surface, wherein the first surface, second surface, step surface, and end surface cooperate to define the cavity.

7. The method of claim 6 wherein the tube is spaced apart from the second surface and the step surface when the tube is positioned in the cavity before the upset punch is actuated.

8. The method of claim 6 wherein the punch shaft portion is received in the through hole of the tube when the upset punch is actuated against the second end of the tube.

9. The method of claim 8 wherein the punch shaft portion engages an inner surface of the tube that defines the through hole when the upset punch is actuated against the second end of the tube.

10. The method of claim 9 wherein the punch end surface is disposed substantially perpendicular to the axis.

11. The method of claim 8 wherein the upset punch includes a flange forming portion that is spaced apart from the punch shaft portion, wherein at least a portion of the tube is disposed between the flange forming portion and the punch shaft portion when the upset punch is actuated against the second end of the tube.

12. The method of claim 11 wherein the punch shaft portion is substantially cylindrical and the flange forming portion is configured as a ring that extends continuously around the punch shaft portion, wherein the flange forming portion and punch shaft portion are concentrically disposed about the axis.

13. The method of claim 12 wherein the punch shaft portion further comprises a bottom punch surface that extends from the punch shaft portion to the flange forming portion, wherein the bottom punch surface engages the second end of the tube when the upset punch is actuated.

14. The method of claim 13 wherein the punch shaft portion has a length that extends further from the bottom punch surface than the flange forming portion.

15. A method of making a forged part comprising:

forging a workpiece configured as a non-tubular billet into a tube that extends along an axis and has a through hole;

positioning the tube in a cavity of an upset die such that a first end of the tube engages an end surface of the upset die that is disposed in a nonparallel relationship with the axis; and actuating an upset punch against a second end of the tube that is disposed opposite the first end to forge a flange between the first and second ends, wherein the flange is disposed opposite the through hole and extends away from the axis and wherein the upset punch has a punch shaft portion that has a punch end surface disposed at a distal end and a flange forming portion that extends around the punch shaft portion, and the flange forming portion is completely received in the upset die and the punch end surface directly engages the end surface of the upset die when the upset punch is actuated into the upset die to forge the flange.

16. The method of claim 15 wherein the end surface is disposed substantially perpendicular to the axis.

17. The method of claim 15 wherein the end surface and the punch end surface are substantially planar.

18. A method of making a forged part comprising:

forging a workpiece configured as a non-tubular billet into a tube that extends along an axis and has a through hole;

positioning the tube in a cavity of an upset die such that a first end of the tube engages an end surface of the upset die; and actuating an upset punch against a second end of the tube that is disposed opposite the first end to forge a flange between the first and second ends, wherein the flange is disposed opposite the through hole and extends away from the axis, the upset punch is disposed on a punch plate and has a punch shaft portion that is cylindrical and extends from a bottom punch surface to a punch end surface that is disposed at a distal end, and the punch plate engages an upper surface of the upset die, the flange forming portion is completely received in the upset die, the bottom punch surface engages the second end of the tube, and the punch end surface directly engages the end surface of the upset die when the upset punch is actuated into the upset die to forge the flange.

19. The method of claim 18 wherein the punch end surface and the end surface are both substantially planar, extend substantially perpendicular to the axis, and are substantially coplanar when the punch end surface engages the end surface.

* * * * *